US005122429A

United States Patent [19]

Sundararajan et al.

[11] Patent Number: 5,122,429

[45] Date of Patent: Jun. 16, 1992

[54] PHOTCONDUCTIVE IMAGING MEMBERS

[75] Inventors: Pudupadi R. Sundararajan, Oakville; Dasarao K. Murti, Mississauga; Terry L. Bluhm, Oakville, all of Canada

[73] Assignee: Xerox Corporation, Stamford, Conn.

[21] Appl. No.: 572,210

[22] Filed: Aug. 24, 1990

[51] Int. Cl.[5] ..... G03G 5/14

[52] U.S. Cl. ..... 430/58; 430/59; 430/64; 430/126

[58] Field of Search ..... 430/69, 58, 59, 64, 430/126

[56] References Cited

U.S. PATENT DOCUMENTS

| | | | |
|---|---|---|---|
| 4,078,927 | 3/1978 | Amidon et al. | 430/96 |
| 4,265,990 | 5/1981 | Stoika et al. | 430/59 |
| 4,559,287 | 12/1985 | McAneney et al. | 430/59 |
| 4,618,551 | 10/1986 | Stoika et al. | 430/58 |
| 4,847,175 | 7/1989 | Paulisko et al. | 430/96 |

*Primary Examiner*—John Goodrow
*Attorney, Agent, or Firm*—E. O. Palazzo

[57] ABSTRACT

A photoresponsive imaging member comprised of a photogenerating layer, and a charge transport layer comprised of charge transport molecules and a resin binder mixture comprised of a polycarbonate and an elastomeric block copolymer.

44 Claims, 1 Drawing Sheet

PHOTCONDUCTIVE IMAGING MEMBERS

BACKGROUND OF THE INVENTION

This invention is generally directed to polymer blends, and imaging members thereof. More specifically, the present invention in an embodiment thereof relates to resin binders comprised of mixtures of polymers and photoconductive members thereof, wherein the mixture functions, for example, to eliminate or minimize crystallization of charge, and especially hole transport molecules selected for the hole transport layer thereby, for example, improving image quality. In another embodiment of the present invention, the mixture selected reduces undesirable cracking of the charge transport layer and permits extended usage thereof, for example the imaging with the charge transport layer can enable excellent images with substantially no background deposits for up to 250,000 imaging cycles in a xerographic imaging test fixture. In another embodiment of the present invention, the binder mixture selected can allow for the fabrication of imaging members with higher concentration of the hole transport molecules and hence higher mobility of holes in the charge transport layer, which can be an advantage in increasing the speed, that is the number of developed copies generated per minute, of, for example, xerographic copiers and printers. In one embodiment of the present invention, there are provided organic photoconductive layered imaging members comprised of photogenerating layers and charge or hole transport layers comprised of aryl amines including, for example, the aryl amines as illustrated in U.S. Pat. Nos. 4,265,990; 4,921,773 and 4,925,760, the disclosures of which are totally incorporated herein by reference, dispersed in mixtures of polymers comprised, for example, of mixtures of polycarbonates with elastomeric block copolymers such as Kraton, including the commercially available Kraton D-1102 and D-1116. Further, in one embodiment of the present invention there is provided a photoresponsive imaging member or device comprised of a supporting substrate, a photogenerating layer comprised of photogenerating pigments optionally dispersed in a resin binder, and a hole transport layer comprised of an aryl amine or a polysilylene, reference U.S. Pat. No. 4,618,551, the disclosure of which is totally incorporated herein by reference, dispersed in mixtures of polymers comprised, for example, of mixtures of polycarbonates with elastomeric block copolymers such as Kraton, including the commercially available Kraton D-1102 and D-1116. The photoresponsive imaging members of the present invention can be selected for various electrophotographic imaging and printing processes, especially xerographic processes wherein, for example, latent images are formed thereon followed by development and transfer to a suitable substrate.

The selection of polysilylenes and aryl amines as hole transport molecules, which molecules are dispersed in resins such as polycarbonates, and the like for utilization in layered photoconductive imaging members are known, reference U.S. Pat. No. 4,618,551, the disclosure of which is totally incorporated herein by reference, and U.S. Pat. No. 4,265,990.

In U.S. Pat. No. 4,559,287 there are disclosed layered photoresponsive imaging members with an electron transporting layer, which layer has been stabilized with, for example, an aryl amine enabling crystallization of the aforementioned layer to be eliminated. The disclosure of this patent is totally incorporated herein by reference.

Illustrated in U.S. Pat. No. 4,315,981 are organic double layered electrophotographic recording materials consisting of an electroconductive support with a photoconductive double layer of organic materials, which consist of a homogeneous opaque charge carrier producing dyestuff layer obtained from an annealed quinone, or the substitution product thereof selected from the group consisting of dibenzopylene, quinone, anthraquinone, pyranthrone, dibenzathrone, and flaventhrone, and a transparent top layer of insulating materials of at least one charge transporting compound, which transport layer consists of a charge transporting monomer, reference for example column 2, lines 37 to 56. Further, as indicated in column 4, lines 1 to 22, as the formula 9 compound for the imaging member of the '981 patent there can be selected dibromo-8,16-pyranthrenedione (Indanthrene Orange RRTS, C.I. 59,705). Moreover, it is indicated in column 4, beginning at around line 53, that the organic dyestuff layer may be applied by vapor depositing the dyestuff in a vacuum. Also, this patent discloses a number of resinous binders for the charge transport layer including polycarbonate resins, reference column 7. Further, in U.S. Pat. No. 3,871,882 there are disclosed layered electrophotographic recording materials containing an electroconductive support material and a photoconductive double layer of organic materials, reference for example the Abstract of the Disclosure. Other representative patents of background interest include U.S. Pat. Nos. 3,871,882 and 3,973,959.

In Konishiroku Kokai Japanese 59/184349/A2[84/184349], Oct. 19, 1984, there is disclosed the use of selected pyranthrones as charge generator layers in conjunction with hydrazone charge transport layers. Specifically, a solution coated dispersion of dibromo-8,16-pyranthrenedione in a polymer binder can be selected as the charge generator layer. Also, in U.S. Pat. No. 3,877,935 there are disclosed imaging members with dibromo-8,16-pyranthrenedione vacuum coated charge generator layers contiguous with poly(vinyl carbazole) charge transport layers.

As a result of a patentability search in a copending application, there were selected U.S. Pat. Nos. 4,028,102; 4,399,207; 4,454,211; 4,554,231 and 4,714,666. In the '102 patent, there are illustrated diamine condensation products in double layered photoconductive recording elements. More specifically, there are disclosed in the '102 patent condensation products of o-phenylamine diamine or 1,8-diaminylnaphthyline and 4,10-benzothioxanthrene-3,1'-dicarboxylic anhydride of the formulas as illustrated in column 2, and of the formulas 1 to 5, reference column 3, beginning at line 55. The '207 patent discloses electrophotographic photosensitive members with hydrazone compounds of the formula, for example, as illustrated in the Abstract of the Disclosure and in column 2. Examples of charge generating layer materials are illustrated beginning in column 16, line 65, and include, for example, phthalocyanine pigments, perylene pigments, and the like, typical examples of which are specifically recited in columns 17 through 26. The '211 patent discloses electrophotographic photosensitive members with pyrazoline charge transport materials, see for example column 2, beginning at line 35. Specific organic photoconductive materials or charge transporting materials for use in the invention of the '211 patent are illustrated, according to the teachings thereof, in columns 3 and 4, formulas 1 and 2, of the '211 patent. Charge generating layers for the photoconductive members in the '211 patent are illustrated in column 42, beginning at line 11, and include, for example, organic substances such as perylium dyes, thioperylium dyes, perylene pigments, and the like with specific examples of charge generating materials being illustrated in columns 42 to 52. Also, it is disclosed in column 57 that a charge generating layer can be formed on aluminum plate by the vacuum deposition of a perylene pigment having carbon atom bridges at the 1, 12 and 6, 7 positions of the common perylene molecule. In U.S. Pat. No. 4,554,231, there is illustrated an electrophotosensitive member comprised of a layer containing hydrazone compound of the formula, for example, as illustrated in the Abstract of the Disclosure, which hydrazone compound is selected as charge transport material, reference column 5, line 30, and wherein there are selected various charge generating layer materials including, for example, perylium dyes, thioperylium dyes, perylene pigments and the like, see column 6, beginning at line 23, and note particularly columns 7 through 12. The use of Vylon 200 on a charge generating layer is disclosed at column 19, lines 15 to 21, and according to the searcher, there is shown at the bottom of column 12 a perylene molecule which may be used, which includes a two carbon atom bridge at both the 1, 12 and 6, 7 positions of a perylene molecule. In the U.S. Pat. No. 4,714,666, there are illustrated perylene tetracarboxylic acid imide pigments in electrophotographic recording materials, which pigments include those, for example, as represented by the formula 1, reference the Abstract of the Disclosure.

Moreover, in U.S. Pat. No. 4,587,189, the disclosure of which is totally incorporated herein by reference, there are illustrated layered imaging members with photoconductive layers comprised of cis and transbis(-benzimidazo)perylene pigments.

Also known are xerographic photoconductive members with a homogeneous layer of a single material such as vitreous selenium, or a composite layered device containing a dispersion of a photoconductive composition. An example of one type of composite xerographic photoconductive member is described, for example, in U.S. Pat. No. 3,121,006 wherein there is disclosed finely divided particles of a photoconductive inorganic compound dispersed in an electrically insulating organic resin binder.

There are also known photoreceptor materials comprised of inorganic or organic materials wherein the charge carrier generating, and charge carrier transport functions are accomplished by discrete contiguous layers. Additionally, layered photoreceptor materials are disclosed in the prior art which include an overcoating layer of an electrically insulating polymeric material. However, the art of xerography continues to advance, and more stringent demands need to be met by the copying apparatus in order to increase performance standards and to obtain quality images. Also, there have been disclosed other layered photoresponsive devices including those comprised of separate generating layers and transport layers as described in U.S. Pat. No. 4,265,990, the disclosure of which is totally incorporated herein by reference. Examples of photogenerating layers disclosed in this patent include trigonal selenium and phthalocyanines, while examples of transport layers include certain diamines as mentioned herein.

A number of other patents are in existence describing photoresponsive devices including layered devices containing generating substances, such as U.S. Pat. No. 3,041,167 which discloses an overcoated imaging member containing a conductive substrate, a photoconductive layer, and an overcoating layer of an electrically insulating polymeric material. This member is utilized in an electrophotographic copying system by, for example, initially charging the member with an electrostatic charge of a first polarity, and imagewise exposing to form an electrostatic latent image, which can be subsequently developed to form a visible image.

Furthermore, there are disclosed in U.S. Pat. Nos. 4,232,102 and 4,233,383 photoresponsive imaging members comprised of trigonal selenium doped with sodium carbonate, sodium selenite, and trigonal selenium doped with barium carbonate, and barium selenite, or mixtures thereof. Moreover, there are disclosed in U.S. Pat. No. 3,824,099 certain photosensitive hydroxy squaraine compositions. According to the disclosure of this patent, the squaraine compositions are photosensitive in normal electrostatographic imaging systems.

In U.S. Pat. No. 4,508,803, the disclosure of which is totally incorporated herein by reference, there is described an improved photoresponsive device comprised of a supporting substrate, a hole blocking layer, an optional adhesive interface layer, an inorganic photogenerating layer, a photoconducting composition layer comprised of benzyl fluorinated squaraine compositions, and a hole transport layer. Other representative patents disclosing photoconductive devices with squaraine components therein include U.S. Pat. Nos. 4,507,408; 4,552,822; 4,559,286; 4,507,480; 4,524,220; 4,524,219; 4,524,218; 4,525,592; 4,559,286; 4,415,639; 4,471,041 and 4,486,520. The disclosures of each of the aforementioned patents are totally incorporated herein by reference.

Moreover, disclosed in the prior art are composite electrophotographic photosensitive materials with various azo compounds. For example, there are illustrated in Japanese Ricoh Patent Publication 6064354, published Apr. 12, 1985, composite photoconductors wherein one of the photoconductor layers contains an azo compound of the formulas as illustrated. Further, there are illustrated in several U.S. patents and publications layered organic electrophotographic photoconductor elements with azo, bisazo, or related compounds. Examples of these patents and publications include U.S. Pat. Nos. 4,400,455; 4,551,404; 4,390,608; 4,327,168; 4,299,896; 4,314,015; 4,486,522; 4,486,519 and 4,551,404; and Konishiroku Japanese Patent Laid Open Publication 60111247.

Other prior art that may be of background interest includes Japanese Patent 59-59686; Japanese Patent 59-154454; European Patent 100,581; U.S. Pat. No. 4,578,334; European Patent 40,402; U.S. Pat. No. 4,431,721; German Patent 3,110,954; R. O. Loutfy, Can. J. Chem 59, 544, (1981); and F. Graser and E. Hadicke, Liebigs Ann. Chem., 483 (1984).

SUMMARY OF THE INVENTION

It is a feature of the present invention to provide charge transport layers with many of the advantages illustrated herein.

Another feature of the present invention is to provide hole transport layers comprised of aryl amines, and the like dispersed in resin binder polymer mixtures whereby, for example, crystallization of the hole transport molecules is eliminated or minimized.

Another feature of the present invention is to provide hole transport layers comprised of aryl amines, and the like dispersed in resin binder polymer mixtures comprised, for example, of polycarbonates and elastomeric copolymers whereby, for example, undesirable cracking of the transport layer and crystallization of the hole transport molecules is inhibited.

Another feature of the present invention is to provide hole transport layers comprised of hole transport molecules and resin binder polymer mixtures that will enable the minimization of crystallization of the aforementioned molecules.

Additionally, in another feature of the present invention there are provided imaging members comprised of photogenerating layers and hole transport layers comprised of hole transport molecules and resin binder polymer mixtures that will enable the minimization of crystallization of the aforementioned molecules.

Furthermore, in another feature of the present invention there are provided imaging members comprised of inorganic or organic photogenerating layers and hole transport layers comprised of hole transport molecules and resin binder polymer mixtures comprised of polycarbonates, such as polycarbonate Z and Kraton, that will enable the minimization of crystallization of the aforementioned molecules.

A further feature of the present invention is the provision of photoconductive imaging members comprised of photogenerating layers and hole transport layers comprised of hole transport molecules and resin binder polymer mixtures comprised of polycarbonates, such as polycarbonate Z and Kraton, and wherein the members in an embodiment of the invention possess high photosensitivity, low dark decay values, and excellent cyclic stability.

In yet another feature of the present invention there are provided negatively charged layered photoresponsive imaging members comprised of photogenerating compounds optionally dispersed in a resinous binder, and in contact therewith hole transport layers comprised of hole transport molecules and resin binder polymer mixtures that will enable the minimization of crystallization of the aforementioned molecules.

There are provided in another feature of the present invention positively charged layered photoresponsive imaging members with a top photogenerating layer comprised of photogenerating pigments optionally dispersed in a resinous binder, and thereunder a hole transport layer comprised of hole transport molecules and resin binder polymer mixtures that will enable the minimization of crystallization of the aforementioned molecules.

Further, in yet another feature of the present invention there are provided imaging and printing methods with the photoresponsive imaging members illustrated herein.

Also, in a further feature of the present invention there are provided improved imaging members sensitive to light in the visible region of the spectrum, that is from about 400 to about 700 nanometers.

Moreover, in a further feature of the present invention there can be provided improved imaging members with extended near infrared response to, for example, 800 nanometers, and improved white light response (panchromaticity).

In one embodiment, the layered photoconductive imaging members of the present invention are comprised of photogenerating layers, and in contact therewith a charge or hole transport layer or layers comprised of aryl amines, polysilylenes and the like dispersed in a resin binder mixture comprised of a polycarbonate and an elastomeric block copolymer.

In an embodiment, the photoconductive layered imaging members of the present invention are comprised of, for example, a supporting substrate, a photogenerating layer comprised of photogenerating pigments comprised of selenium, selenium alloys, metal free phthalocyanine, metal phthalocyanines, vanadyl phthalocyanines, titanyl phthalocyanines, perylenes, squaraines, and other similar inorganic or organic photogenerating pigments; and a hole transport layer comprised of aryl amines dispersed in a resin binder mixture comprised of a polycarbonate and an elastomeric block copolymer available as Kraton.

With further respect to the photoconductive imaging members of the present invention, the photogenerating layer can be situated between the supporting substrate and the hole transport layer; or alternatively, the hole transport layer may be situated between the supporting substrate and the layer comprised of known photogenerating pigments. The imaging members may also include protective overcoatings thereover including polymers such as polyurethanes, polycarbonates and the like with a thickness of from about 0.2 micron to about 10 microns, or other effective thicknesses.

In an illustrative embodiment, the photoconductive imaging member of the present invention is comprised of (1) a supporting substrate; (2) a hole blocking layer; (3) an optional adhesive interface layer; (4) a photogenerating layer comprised of inorganic or organic photogenerating pigments; and (5) a hole transport layer comprised of aryl amines dispersed in a resin binder mixture comprised of a polycarbonate and an elastomeric block copolymer available as Kraton present in an effective amount of, for example, from about 1 to about 20, and preferably from about 5 to about 10 weight percent. Therefore, the photoconductive imaging member of the present invention in one embodiment is comprised of a conductive supporting substrate, a hole blocking organo silane or siloxane or metal oxide layer in contact therewith, an adhesive layer, such as 49,000 polyester available from Goodyear Chemical, a photogenerating layer overcoated on the adhesive layer, and as a top layer a hole transport layer comprised of an aryl amine dispersed in a polycarbonate and an elastomeric block copolymer available as Kraton present in an effective amount of, for example, from about 1 to about 20, and preferably from about 5 to about 10 weight percent.

Various known processes can be selected for the preparation of the photoconductive imaging members of the present invention, the process parameters in the order of coating of the layers being dependent on the member desired. Specifically, for example, in one method the photogenerating layer is deposited on a supporting substrate by vacuum sublimation, and subsequently the hole transport layer mixture is deposited thereover by solution coating. In another process variant, the layered photoconductive device can be prepared by providing the conductive substrate containing the hole blocking layer and an optional adhesive layer, and applying thereto by solvent coating processes, laminating processes, or other methods, the photogenerating layer and the charge transport layer mixture. In one illustrative embodiment, the photoconducting imaging member of the present invention is comprised of (1) a conductive supporting substrate of Mylar with a thickness of 75 microns and a conductive vacuum deposited layer of titanium with a thickness of 0.02 micron; (2) a hole blocking layer of N-methyl-3-aminopropyltrimethoxy silane with a thickness of 0.1 micron; (3) an adhesive layer of 49,000 polyester (obtained from E.I. DuPont Chemical Company) with a thickness of 0.05 micron; (4) a photogeneration layer of trigonal selenium with a thickness of 1 micron; and (5) a charge transport layer with a thickness of 20 microns of an aryl amine (40 percent by weight) dispersed in a resin binder mixture of a blend of bisphenol A polycarbonate (55 percent by weight) and an elastomeric block copolymer of styrene and butadiene (5 percent by weight).

In an embodiment of the present invention the photogenerating pigments selected can be purified prior to incorporation in the imaging members by fractional sublimation, which involves subjecting the pigments to a temperature of from about 500° to 650° C., whereby impurities and decomposition products more volatile than the desired components are separated at a temperature zone of below 200° C. There are thus obtained the desired purified photogenerating components at a purity of at least about 95 percent at a temperature zone of from about 290° to 460° C. separated from the nonvolatile impurities, which remain at the high temperature (500° to 650° C.) zone. The sublimation apparatus that may be selected has been described by H. J. Wagner et al. in Journal of Materials Science, Vol. 17, pages 2781 to 2791, (1982), the disclosure of which is totally incorporated herein by reference.

The improved photoconductive imaging members of the present invention can be incorporated into numerous imaging processes and apparatuses inclusive of those well known in the art such as xerographic imaging and printing processes. Specifically, the imaging members of the present invention are useful in xerographic imaging processes wherein the photogenerating pigments utilized absorb light of a wavelength of from about 400 nanometers to about 700 nanometers. In these processes, electrostatic latent images are initially formed on the imaging member, followed by development with a toner, reference for example U.S. Pat. Nos. 4,904,762 and 4,937,157 as well as the appropriate patents mentioned in the '762 and the '157 patents, the disclosures of all of the aforementioned patents being totally incorporated herein by reference; and thereafter transferring the image to a suitable substrate.

BRIEF DESCRIPTION OF THE DRAWINGS

For a better understanding of the present invention and further features thereof, reference is made to the following detailed description of various embodiments wherein.

DESCRIPTION OF SPECIFIC EMBODIMENTS

Specific embodiments of the present invention will now be provided with reference to specific photoconductive imaging members containing resin binders comprised of mixtures of polycarbonates and elastomeric block copolymers.

Figure 1:
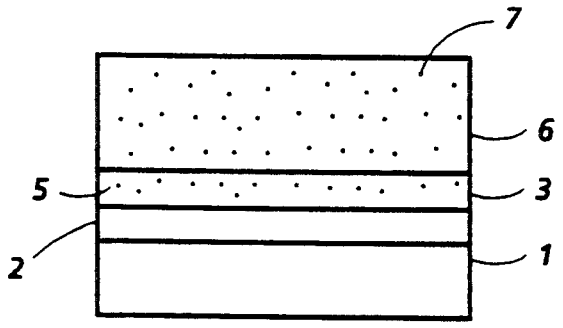
FIG. 1 is a partially schematic cross-sectional view of a photoresponsive imaging member of the present invention in which the photogeneration layer is situated between a substrate and a charge transport layer.

Illustrated in FIG. 1 is a photoresponsive imaging member of the present invention comprised of a substrate 1, an adhesive layer 2, a photogenerator layer 3 comprised of an inorganic, or an organic photogenerating pigment optionally dispersed in a resinous binder composition 5, and a charge carrier hole transport layer 6 comprised of a mixture of an aryl amine small molecule, such as N,N'-diphenyl-N,N'-bis(3-methylphenyl)-[1,1'-biphenyl]-4,4'-diamine, dispersed in a resin binder mixture 7 comprised of a polycarbonate and an elastomeric block copolymer available as Kraton D-1102 (poly(b-styrene-b-butadiene-b-styrene).

Figure 2:
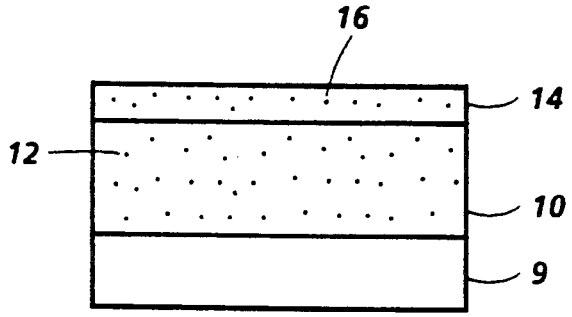
FIG. 2 is a partially schematic cross-sectional view of a photoresponsive imaging member of the present invention in which a charge transport layer is situated between the photogeneration layer and a substrate.

Illustrated in FIG. 2 is a photoresponsive imaging member in which the hole transport layer is situated between the supporting substrate and the photogenerating layer. More specifically, with reference to this Figure, there is illustrated a photoconductive imaging member comprised of a supporting substrate 9, a hole transport layer 10 comprised of aryl amine molecules, such as N,N'-diphenyl-N,N'-bis(3-methylphenyl)-[1,1'-biphenyl]-4,4'-diamine, from about 40 to about 60 weight percent dispersed in a resin binder mixture 12 comprised of a polycarbonate and an elastomeric block copolymer available as Kraton D-1116 poly(b-styrene-b-butadiene-b-styrene), and a photogenerating layer 14 comprised of an inorganic or organic photogenerating pigment optionally dispersed in a resinous binder composition 16.

Figure 3:
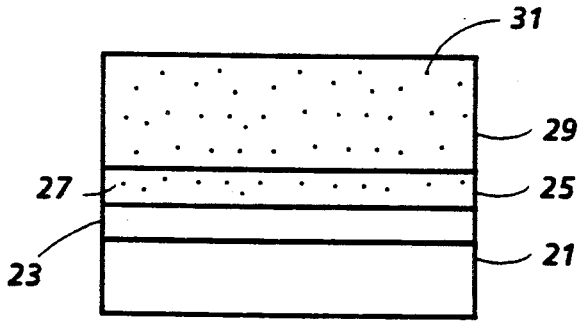
FIG. 3 is a partially schematic cross-sectional view of a photoresponsive imaging member of the present invention.

Illustrated in FIG. 3 is a photoresponsive imaging member which is composed of a supporting substrate 21, such as Mylar, of a thickness of from about 1 mil to about 10 mils; an adhesive layer 23 of, for example, a polyester; a photogenerator layer 25 comprised of an inorganic or an organic photogenerating pigment, such as amorphous selenium, selenium alloys, metal free phthalocyanines, metal phthalocyanines, vanadyl phthalocyanines, titanyl phthalocyanine, optionally dispersed in a resinous binder composition 27, and a charge carrier hole transport layer 29 comprised of aryl amine molecules, such as N,N'-diphenyl-N,N'-bis(3-methylphenyl)-[1,1'-biphenyl]-4,4'-diamine, dispersed in a resin binder mixture 31 comprised of a polycarbonate and an elastomeric block copolymer available as Kraton D-1116 poly(b-styrene-b-butadiene-b-styrene).

With further reference to the imaging members of the present invention, the substrates may comprise a layer of insulating material, such as an inorganic or organic polymeric material including Mylar, a commercially available polymer; a layer of an organic or inorganic material having a semiconductive surface layer such as indium tin oxide or aluminum arranged thereon, or a conductive material, such as, for example, aluminum, chromium, nickel, titanium, brass, or the like. The substrate may be flexible or rigid and may have a number of many different configurations, such as, for example, a plate, a cylindrical drum, a scroll, an endless flexible belt, a seamless support, and the like. In an embodiment, the substrate is in the form of an endless flexible belt. In some situations, it may be desirable to coat on the back of the substrate, particularly when the substrate is an organic polymeric material, an anticurl layer, such as, for example, polycarbonate materials commercially available as Makrolon. The thickness of the substrate layer depends on many factors, including economical considerations, thus this layer may be of substantial thickness, for example over 100 mils, or of minimum thickness providing there are no adverse effects on the system. In one embodiment, the thickness of this layer is from about 3 mils to about 10 mils.

The optional adhesive layers are typically comprised of a polymeric material including polyesters, poly(vinyl butyral), poly(vinyl pyrrolidone), and the like. Typically, this layer is of a thickness of less than about 5 microns with a preferred thickness in the range of about 0.01 micron to about 0.1 micron. The imaging member of the present invention can include other layers therein as illustrated hereinbefore, including metal oxide layers such as aluminum oxide and siloxanes, reference U.S. Pat. No. 4,464,450, the disclosure of which is totally incorporated herein by reference. Generally, the thickness of these layers is from about 0.5 to about 1 micron, however, other thicknesses can be selected.

The photogenerating layers are generally of a thickness of from about 0.05 micron to about 10 microns, or more, and preferably are of a thickness of from about 0.1 micron to about 3 microns; however, the thickness of this layer is primarily dependent on the photogenerator weight loading which may vary from about 5 to 100 percent. Generally, it is desirable to provide this layer in a thickness which is sufficient to absorb about 90 percent or more of the incident radiation which is directed upon it, and the imagewise or printing exposure step. The maximum thickness of this layer is dependent primarily upon factors such as mechanical considerations, for example, whether a flexible photoconductive imaging member is desired. the thicknesses of the other layers, and the specific pyranthrone compound selected. Examples of photogenerating pigments include selenium, selenium alloys, such as selenium arsenic, selenium tellurium, selenium arsenic tellurium; selenium alloys doped with, for example, a halogen, such as chlorine in an amount of from about 50 to about 200 parts per million by weight, metal phthalocyanines, metal free phthalocyanines, vanadyl phthalocyanine, titanyl phthalocyanine, squaraines, perylenes, and the like. Examples of photogenerating layers, especially since they permit imaging members with a photoresponse of from about 400 to about 700 nanometers, for example, include those comprised of known photoconductive charge carrier generating materials, such as amorphous selenium, selenium alloys, halogen doped amorphous selenium, doped amorphous selenium alloys doped with chlorine in the amounts of from about 50 to about 200 parts per million, and trigonal selenium, cadmium selenide, cadmium sulfur selenide, and the like, reference U.S. Pat. Nos. 4,232,102 and 4,233,283, the disclosures of each of these patents being totally incorporated herein by reference. Examples of specific alloys include selenium arsenic with from about 95 to about 99.8 weight percent of selenium; selenium tellurium with from about 70 to about 90 weight percent of selenium; the aforementioned alloys containing dopants, such as halogens, including chlorine in the amount of from about 100 to about 1,000 parts per million, ternary alloys, and the like. The thickness of the photogenerating layer is dependent on a number of factors, such as the materials included in the other layers, and the like; generally, however, this layer is of a thickness of from about 0.1 micron to about 5 microns, and preferably from about 0.2 micron to about 2 microns, depending on the photoconductive volume loading, which may vary from about 5 percent to about 100 percent by weight. Generally, it is desirable to provide this layer in a thickness which is sufficient to absorb about 90 percent or more of the incident radiation which is directed upon it in the imagewise exposure step. The maximum thickness of this layer is dependent primarily upon factors such as mechanical considerations, for example, whether a flexible photoresponsive device is desired. Also, there may be selected as photogenerators organic components, such as squaraines, perylenes, reference for example U.S. Pat. No. 4,587,189, the disclosure of which is totally incorporated herein by reference, metal phthalocyanines, metal free phthalocyanines, vanadyl phthalocyanine, dibromoanthanthrone and the like.

Various suitable hole transport molecules can be selected for the hole transport layer mixture of the present invention, which layer has a thickness, for example, of from about 5 microns to about 75 microns, and preferably is of a thickness of from about 10 microns to about 40 microns. In an embodiment, the transport layer comprises aryl amine molecules present in an effective amount of for example from about 10 to about 80 weight percent, and preferably from about 40 to about 60 weight percent of the following formula

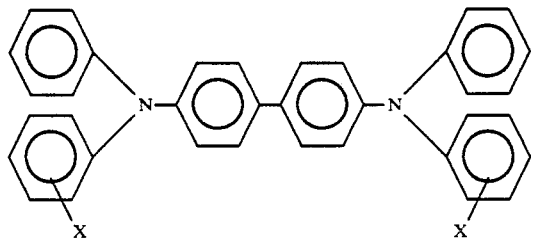

dispersed in a resin binder mixture wherein X is selected from the group consisting of alkyl with, for example, from about 1 to about 20 carbon atoms, such as methyl, ethyl, propyl, butyl, pentyl, hexyl, heptyl, octyl, decyl and the like, and halogen; and in an embodiment X can be (ortho) $CH_3$, (meta) $CH_3$, (para) $CH_3$, (ortho) Cl, (meta) Cl, or (para) Cl.

Compounds corresponding to the above formula include, for example, N,N'-diphenyl-N,N'-bis(alkylphenyl)-[1,1-biphenyl]-4,4'-diamine wherein the alkyl is selected from the group consisting of methyl, such as 2-methyl, 3-methyl, and 4-methyl, ethyl, propyl, butyl, hexyl, and the like. With halo substitution, the amine is N,N'-diphenyl-N,N'-bis(halo phenyl)-[1,1'-biphenyl]-4,4'-diamine, wherein halo is 2-chloro, 3-chloro, or 4-chloro. Other hole transport molecules can be selected including (TPD) or N,N'-diphenyl-N,N'-bis(3-methylphenyl){1,1'-biphenyl}4,4'diamine. Other hole transports can be selected, reference the patents mentioned herein.

Examples of polysilylene hole transport molecules present in various effective amounts, such as, for example, from about 60 to about 40 weight percent, include the polysilylenes of U.S. Pat. No. 4,618,551, the disclosure of which is totally incorporated herein by reference. Specific polysilylenes include polysilylenes of the formula

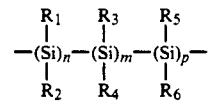

wherein $R_1$, $R_2$, $R_3$, $R_4$, $R_5$, and $R_6$ are independently selected from the group consisting of alkyl, aryl with, for example, from 6 to about 24 carbon atoms, such as phenyl, substituted alkyl, substituted aryl, and alkoxy; and m, n, and p are numbers that reflect the percentage of the particular monomer unit in the total polymer compound. Preferred polysilylenes include poly(methylphenyl silylenes), which polysilylenes preferably have a weight average molecular weight of in excess of 1,000, such as from about 5,000 to about 2,000,000. Polysilylenes or polygermylenes with a weight average molecular weight of from about 75,000 to about 1,000,000 are usually selected in some embodiments. The aforementioned polysilylenes can be prepared by known methods, reference the Journal of Organometallic Chemistry, page 198, C27, (1980), R. E. Trujillo, the disclosure of which is totally incorporated herein by reference. Also, other polysilylenes can be prepared as described in the Journal of Polymer Science, Polymer Chemistry Edition, Vol. 22, pages 225 to 238, (1984), John Wiley and Sons, Inc., the disclosure of which is totally incorporated herein by reference. More specifically, the aforementioned polysilylenes can be prepared as disclosed in the aforesaid article by the condensation of a dichloromethyl phenyl silane with an alkali metal such as sodium. In one preparation sequence, there is reacted a dichloromethyl phenyl silane in an amount of from about 0.1 mole with sodium metal in the presence of 200 milliliters of solvent in which reaction is accomplished at a temperature of from about 100° C. to about 140° C. There results, as identified by elemental analysis, infrared spectroscopy, UV spectroscopy, and nuclear magnetic resonance, the polysilylene products subsequent to the separation thereof from the reaction mixture.

Illustrative specific examples of polysilylene compounds that may be selected include poly(methylphenyl silylene), poly(methylphenyl silylene-co-dimethyl silylene), poly(cyclohexylmethyl silylene), poly(tertiarybutylmethyl silylene), poly(phenylethyl silylene), poly(n-propylmethyl silylene), poly(p-tolylmethyl silylene), poly(cyclotrimethylene silylene), poly(cyclotetramethylene silylene), poly(cyclopentamethylene silylene), poly(di-t-butyl silylene-co-di-methyl silylene), poly(diphenyl silylene-cophenylmethyl silylene), poly(cyanoethylmethyl silylene), poly(phenylmethyl silylene), and the like. Preferred polysilylenes selected for the toner compositions of the present invention include poly(methylphenyl) silylene, poly(cyclohexylmethyl) silylene, and poly(phenethylmethyl) silylene.

Examples of resin binder mixtures for the hole transport molecules include a polycarbonate, or similar polymer from about 25 to about 80 percent by weight and in an embodiment from about 35 to 50 percent by weight, and an elastomeric block copolymer, such as Kraton® 1102, from about 2 to about 20 percent by weight, and in an embodiment, about 5 percent by weight. Further, in an embodiment, the presence of about 5 percent by weight of the elastomeric block copolymer in the binder mixture resulted in avoiding the crystallization of charge transport molecules, such as TPD, N,N'-diphenyl-N,N'-bis(3-methylphenyl)-[1,1'-biphenyl]-4,4'-diamine. Mixtures of binders as illustrated herein can enable the minimization of crystallization, for example crystalliztion is less that about 1 percent, and in embodiments, about 0.50 to 0.75 percent.

Examples of optional highly insulating and transparent resinous material or inactive binder resinous material for the photogenerating layer include materials such as those described in U.S. Pat. No. 3,121,006, the disclosure of which is totally incorporated herein by reference. Specific examples of organic resinous materials include polycarbonates, acrylate polymers, vinyl polymers, cellulose polymers, polyester, polysiloxanes, polyamides, polyurethanes, polyvinyl carbazole and epoxies as well as block, random or alternating copolymers thereof. For the binder mixture, one component thereof for the hole transport is polycarbonate resins having a molecular weight ($M_w$) of from about 20,000 to about 300,000 with a molecular weight in the range of from about 50,000 to about 300,000 being particularly preferred in embodiments. Generally, the resinous binder contains from about 10 to about 75 percent by weight of the charge transport material corresponding to the foregoing formula, and preferably from about 35 percent to about 50 percent of this material. Polyvinyl carbazole can be a preferred binder for the photogenerator pigment.

Also included within the scope of the present invention are methods of imaging with the photoresponsive devices illustrated herein. These methods generally involve the formation of an electrostatic latent image on the imaging member; followed by developing the image with known developer compositions, reference for example U.S. Pat. Nos. 3,590,000; 4,469,770; 4,560,635 and 4,298,672, the disclosures of which are totally incorporated herein by reference; subsequently transferring the image to a suitable substrate; and permanently affixing the image thereto.

Illustrative examples of toners with charge enhancing additives that may be selected for image development and present in the toner or admixed therewith in various effective amounts, such as, for example, from about 0.05 to about 10 percent by weight, and more preferably from about 0.5 to about 2 percent by weight, and usually enabling positively charged toner compositions with a triboelectric charge, for example, of from about 15 to about 40 microcoulombs per gram, include alkyl pyridinium halides, such as cetyl pyridinium chlorides, reference U.S. Pat. Nos. 4,298,672, the disclosure of which is totally incorporated herein by reference; cetyl pyridinium tetrafluoroborates, quaternary ammonium sulfate, and sulfonate charge control agents, such as stearyl phenethyl dimethyl ammonium tosylates as illustrated in U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate, Broton P51 available from Orient Chemical Company; TP-302, a quaternary ammonium salt available from Nachem, Inc; charge control agents which have been surface treated with colloidal silicas such as Aerosils; mixtures of colloidal silicas and charge additives; colloidal silicas surface treated with charge control additives; and other known similar charge enhancing additives as illustrated in the U.S. patents mentioned herein, the disclosures of which have been totally incorporated herein by reference; and the like. Examples of charge enhancing additives present in various effective amounts, such as, for example, from about 0.05 to about 10 percent by weight, and preferably from about 1 to about 5 percent by weight, and more preferably from about 0.5 to about 2 weight percent, that enable negatively charged toners with a triboelectric charge, for example, of from about −15 to about −40 microcoulombs per gram include Spilon TRH available from Hodogaya Chemical, orthohalophenylcarboxylic acids, reference U.S. Pat. No. 4,411,974, the disclosure of which is totally incorporated herein by reference, potassium tetraphenyl borates, and the like. With respect to the aforementioned positively charged toners, depending on a number of factors, including the carrier selected and the amount of charge enhancing additive utilized, generally the triboelectric charge is from about a +15 microcoulombs per gram to about a +40 microcoulombs per gram, and preferably from a +20 microcoulombs per gram to about a +35 microcoulombs per grams. A similar charge with a negative polarity can be present on the toner with negative charge enhancing additives such as those of the '974 patent.

Illustrative examples of carrier particles that can be selected for mixing with the toner compositions, thus permitting two component developers, include those particles that are capable of triboelectrically obtaining a charge of opposite polarity to that of the toner particles. Accordingly, the carrier particles can be selected to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include steel, nickel, iron, ferrites, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover, several of which are illustrated, for example, in U.S. Ser. No. 751,922 (abandoned) relating to developer compositions with certain carrier particles, the disclosure of which is totally incorporated herein by reference. More specifically, there are illustrated in the aforementioned application carrier particles comprised of a core with a coating thereover of vinyl polymers or vinyl homopolymers. Examples of specific carriers illustrated in the application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride and trichlorofluoroethylene; and other known coatings. There can also be selected as carriers components comprised of a core with a double polymer coating thereover, reference U.S. Pat. Nos. 4,937,166 and 4,935,326, the disclosures of which are totally incorporated herein by reference. More specifically, there are detailed in these patents carrier particles with substantially stable conductivity parameters comprised of a core and a polymer mixture thereover, which polymers are not in close proximity in the triboelectric series, and wherein the carriers can be prepared by, for example, (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, thus allowing these particles to possess sufficient density to avoid adherence to the electrostatic images during the development process. The carrier particles can be mixed with the toner particles in various suitable combinations, however, in embodiments, from about 1 to about 5 parts per toner to about 10 parts to about 200 parts by weight of carrier are mixed.

The invention will now be described in detail with reference to specific preferred embodiments thereof, it being understood that these examples are intended to be illustrative only. The invention is not intended to be limited to the materials, conditions, or process parameters recited herein. Also, all parts and percentages are by weight unless otherwise indicated.

EXAMPLE I.

A coating solution was prepared by dissolving 1.0 gram of N,N'-diphenyl-N,N'-bis(3-methylphenyl)-[1,1'-biphenyl]-4,4'-diamine (TPD), 0.9 gram of bisphenol A polycarbonate (Makrolon R) and 0.1 gram of the elastomeric block copolymer Kraton D-1102 (Shell Chemical Company) in 20 grams of methylene chloride. This solution was coated on top of a glass substrate (0.5 centimeter thick) by means of a Bird film applicator. The resulting film was then dried in a forced air oven at 135° C. for 20 minutes and subsequently annealed at 140° C. for 30 minutes. The film was separated from the glass substrate with a sharp knife and used for measurements of crystallinity. Crystallinity of TPD in the annealed film was measured by scanning differential calorimetry. Less than 1 percent (about 0.75) by weight crystallization of TPD was observed, compared with 10 percent by weight for a similar film containing no Kraton D-1102 and prepared and measured in an identical manner. The percentage of crystallization was calculated by a comparison of the heat of fusion values measured from the film versus the heat of fusion obtained from 100 percent crystalline TPD.

EXAMPLE II

A film was cast from methylene chloride containing 10 percent by weight solids containing 5 percent by weight of Kraton D-1102 obtained from Shell Chemical Company, 40 percent by weight of (TPD) N,N'-diphenyl-N,N'-bis(3-methylphenyl)-[1,1'-biphenyl]-4,4'-diamine, and 55 percent by weight of bisphenol A polycarbonate (Makrolon R). This film was dried in a forced air oven at 135° C. for 20 minutes and subsequently annealed at 140° C. for 30 minutes. Crystallinity of TPD in the annealed film was measured by scanning differential calorimetry, and less than 1 percent crystallization of TPD was observed, compared with 4 percent by weight for a similar film containing no Kraton D-1102 and prepared and measured in an identical manner.

EXAMPLE III

A film was cast with a Bird applicator, reference Example I, from methylene chloride containing 10 percent by weight of solids containing 5 percent by weight of Kraton D-1116 obtained from Shell Chemical Company, 50 percent by weight of (TPD) N,N'-diphenyl-N,N'-bis(3-methylphenyl)-[1,1'-biphenyl]-4,4'-diamine, and 45 percent by weight of bisphenol A polycarbonate (Makrolon R). This film was dried in a forced air oven at 135° C. for 20 minutes and subsequently annealed at 140° C. for 30 minutes. Crystallinity of TPD in the annealed film was measured by scanning differential calorimetry. Less than 1 percent crystallization of TPD was observed, compared with 10 percent by weight for a film containing no Kraton D-1116 and prepared and measured in an identical manner.

EXAMPLE IV

A film was cast with a Bird applicator, reference Example I, from methylene chloride containing 10 percent by weight of solids containing 5 percent by weight of Kraton D-1116 purchased from Shell Chemical Company, 40 percent by weight of (TPD) N,N'-diphenyl-N,N'-bis(3-methylphenyl)-[1,1'-biphenyl]-4,4'-diamine and 55 percent by weight of bisphenol A polycarbonate (Makrolon R). This film was dried in a forced air oven at 135° C. for 20 minutes and subsequently annealed at 140° C. for 30 minutes. Crystallinity of TPD in the annealed film was measured by scanning differential calorimetry. Less than 1 percent crystallization of TPD was observed, compared with 4 percent by weight for a film containing no Kraton D-1116 and prepared and measured in an identical manner.

EXAMPLE V

A photoresponsive imaging member comprised of a mixture of polycarbonate and the elastomeric block copolymer Kraton D-1102 as the resinous binder in the hole transport layer and vanadyl phthalocyanine as the photogenerator was prepared as follows:

A titanized Mylar substrate with a thickness of about 75 microns comprised of Mylar with a thickness of 75 microns and titanium film with a thickness of 0.02 micron was obtained from Martin Processing Inc. The titanium film was coated with a solution of 1 milliliter of 3-aminopropyl trimethoxysilane in 100 milliliters of ethanol. The coating was heated at 110° C. for 10 minutes resulting in the formation of a 0.1 micron thick polysilane layer. The polysilane layer functions, it is believed, as a hole blocking layer and prevents the injection of holes from the titanium film and blocks the flow of holes into the charge generation layer. The polysilane layer can be selected to obtain the desired initial surface charge potential of about −800 volts for this imaging member. A dispersion of a photogenerator prepared by ball milling a mixture of 0.07 gram of vanadyl phthalocyanine and 0.13 gram of Vitel PE-200 polyester (Goodyear) in 12 milliliters of methylene chloride for 24 hours was coated by means of a Bird film applicator on top of the polysilane layer. After drying the coating in a forced air oven at 135° C. for 10 minutes, a 0.5 micron thick vanadyl phthalocyanine photogenerating layer with 35 percent by weight of vanadyl phthalocyanine and 65 percent by weight of polyester was obtained.

A solution for the hole transport layer of imaging member 1 was then prepared by dissolving 1.0 gram of N,N'-diphenyl-N,N'bis(3-methylphenyl)-[1,1'-biphenyl]-4,4'-diamine (TPD), and 1.0 gram of Makrolon® polycarbonate in 10 milliliters of methylene chloride. This solution was then coated over the photogenerator layer by means of a Bird film applicator. The resulting layered photoconductive imaging member 1 was then dried in a forced air oven at 135° C. for 20 minutes resulting in a 20 micron thick hole transport layer.

A solution for the charge transport layer of imaging member 2 was then prepared by dissolving 1.0 gram of N,N'-diphenyl-N,N'bis(3-methylphenyl)-[1,1'-biphenyl]-4,4'-diamine (TPD), 0.9 gram of Makrolon polycarbonate, and 0.1 gram of the elastomeric block copolymer Kraton D-1102 in 10 milliliters of methylene chloride. This solution was then coated over the photogenerator layer by means of a Bird film applicator. The resulting layered photoconductive imaging member 2 was then dried in a forced air oven at 135° C. for 20 minutes resulting in a 20 micron thick hole transport layer.

The xerographic electrical properties of the aforementioned imaging members 1 and 2 were then determined by electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members reached a surface potential of $V_{ddp}$, dark development potential, and each member was then exposed to light from a filtered Xenon lamp with a XBO 150 watt bulb. A reduction in surface potential to a $V_{bg}$ value, background potential due to photodischarge effect, was observed. The background potential was reduced by exposing with a light intensity about 10 times greater than the expose energy. The resulting potential on the imaging member was designated as the residual potential, Vr. The dark decay in volt/second was calculated as $(V_o-V_{ddp})/0.5$. The percent of photodischarge was calculated as 100 percent $(V_{ddp}-V_{bg})/V_{ddp}$. The desired wavelength and energy of the expose light was determined by the type of filters placed in front of the lamp. The broad band white light (400 to 700 nanometers) photosensitivity of these imaging members was measured by using an infrared cut-off filter whereas the monochromatic light photosensitivity was determined using a narrow band-pass filter.

The photosensitivity of the imaging members is usually provided in terms of the amount of expose energy in erg/cm$^2$, designated as $E_{\frac{1}{2}}$, required to achieve 50 percent of photodischarge from the dark development potential. The higher the photosensitivity, the smaller is the $E_{\frac{1}{2}}$ value.

Table 1 summarizes the xerographic electricals of the aforementioned imaging members. The background potential, dark decay and photosensitivity values measured with 830 nanometers of light are listed in Table 1.

TABLE 1

| Imaging Member | Charge Transport Layer | Background Potential V | Dark Decay V/s | $E_{\frac{1}{2}}$ erg/cm$^2$ |
|---|---|---|---|---|
| 1 | 50% TPD<br>50% Polycarbonate Bisphenol A (Makrolon ®) | 125 | 40 | 6.5 |
| 2 | 50% TPD<br>45% Polycarbonate<br>5% Kraton D-1102 | 100 | 30 | 6.0 |

For the imaging member 2, the dark development potential was 785 volts and the residual potential was 30 volts. A control imaging member 1, described above with no addition of the elastomeric block copolymer, Kraton D-1102, had a dark development potential of 780 volts and a residual potential of 40 volts. The electrical properties of both the imaging members 1 and 2 remained essentially unchanged after 1,000 cycles of repeated charging and discharging. Also, the crystallinity of the hole transport molecules of imaging member 2 is believed to be less than 1 percent in view of the addition of 5 percent of Kraton D-1102 to 45 percent of polycarbonate and 50 percent of TPD.

EXAMPLE VI

A layered photoreponsive imaging member comprised of N,N'-diphenyl-N,N'bis(3-methylphenyl)-[1,1'-biphenyl]-4,4'-diamine (TPD) molecularly dispersed in a mixture of polycarbonate and the elastomeric block copolymer Kraton D-1102 as the charge transport layer, and a trigonal selenium generator layer was fabricated as follows:

A dispersion of trigonal selenium and poly(N-vinyl carbazole) was prepared by ball milling 1.6 grams of trigonal selenium and 1.6 grams of poly(N-vinyl carbazole) in 14 milliliters each of tetrahydrofuran and toluene. Ten grams of the resulting slurry was then diluted with a solution of 0.24 gram of N,N'-diphenyl-N,N'bis(3-methylphenyl)-[1,1'-biphenyl]-4,4'-diamine (TPD) in 5 milliliters each of tetrahydrofuran and toluene. A 1.5 micron thick photogenerator layer was fabricated by coating the above dispersion onto an aluminized Mylar substrate, thickness of 75 microns, with a Bird film applicator, followed by drying in a forced air oven at 135° C. for 5 minutes. A solution for the hole transport layer was then prepared by dissolving 0.8 gram of N,N'-diphenyl-N,N'bis(3-methylphenyl)-[1,1'-biphenyl]-4,4'-diamine (TPD), 1.0 gram of Makrolon ® polycarbonate, and 0.2 gram of the elastomeric block copolymer Kraton D-1102 in 10 milliliters of methylene chloride. This solution was then coated over the photogenerator layer by means of a Bird film applicator. The resulting member was then dried in a forced air oven at 135° C. for 20 minutes resulting in a 20 micron thick hole transport layer.

The fabricated imaging member was tested electrically in accordance with the procedure of Example V. Specifically, this imaging member was negatively charged to 800 volts and discharged when exposed to white light of wavelengths of 400 to 700 nanometers. The half decay exposure sensitivity for this device was 3 ergs/cm$^2$ and the residual potential was 15 volts. The electrical properties of this imaging member remained essentially unchanged after 1,000 cycles of repeated charging and discharging.

EXAMPLE VII

A layered photoreponsive imaging member comprised of TPD molecularly dispersed in a mixture of polycarbonate and an elastomeric block copolymer, such as Kraton D-1102, as the hole transport layer, and a trigonal selenium generator layer was fabricated as follows:

A dispersion of trigonal selenium and poly(N-vinyl carbazole) was prepared by ball milling 1.6 grams of trigonal selenium and 1.6 grams of poly(N-vinyl carbazole) in 14 milliliters each of tetrahydrofuran and toluene. Ten grams of the resulting slurry was then diluted with a solution of 0.24 gram of N,N'-diphenyl-N,N'bis(3-methylphenyl)-[1,1'-biphenyl]-4,4'-diamine (TPD) in 5 milliliters each of tetrahydrofuran and toluene. A 1.5 micron thick photogenerator layer was fabricated by coating the above dispersion onto an aluminized Mylar substrate, thickness of 75 microns, with a Bird film applicator, followed by drying in a forced air oven at 135° C. for 5 minutes. A solution for the hole transport layer was then prepared by dissolving 0.8 gram of N,N'-diphenyl-N,N'bis(3-methylphenyl)-[1,1'-biphenyl]-4,4'-diamine (TPD), 0.5 gram of Makrolon ® polycarbonate, and 0.7 gram of the elastomeric block copolymer Kraton D-1102 in 10 milliliters of methylene chloride. This solution was then coated over the photogenerator layer by means of a Bird film applicator. The resulting member was then dried in a forced air oven at 135° C. for 20 minutes resulting in a 20 micron thick charge transport layer.

The fabricated imaging member was tested electrically in accordance with the procedure of Example V. Specifically, this imaging member was negatively charged to 800 volts and discharged when exposed to white light of wavelengths of 400 to 700 nanometers. The half decay exposure sensitivity for this device was 50 ergs/cm$^2$ and the residual potential was 80 volts. The electrical properties of this imaging member changed after 1,000 cycles of repeated charging and discharging. For example, the residual potential increased by 120 volts in 1,000 cycles indicating, it is believed, that images of excellent resolution can be initially produced, the copy quality could degrade after extended use, and background may print out. The hole transport layer of this imaging member was comprised of 40 percent by weight of TPD, 25 percent by weight of polycarbonate, and 35 percent by weight of the elastomeric block copolymer Kraton D-1102.

EXAMPLE VIII

A layered photoreponsive imaging member comprised of TPD molecularly dispersed in a mixture of polycarbonate and the elastomeric block copolymer Kraton D-1116 as the hole transport layer, and a squarylium pigment generator layer was fabricated as follows:

An aluminized Mylar substrate was coated with a solution of 1 milliliter of 3-aminopropyl trimethoxysilane in 100 milliliters of ethanol. The coating was heated at 110° C. for 10 minutes resulting in the formation of a 0.1 micron thick polysilane layer. A dispersion for the photogenerator layer prepared by ball milling a mixture of 0.07 gram of bis(N,N'-dimethylaminophenyl) squaraine and 0.13 gras of Vitel PE-200 polyester (Goodyear) in 12 milliliters of methylene chloride for 24 hours was then coated by means of a Bird film applicator on top of the polysilane layer. After drying the coating in a forced air oven at 135° C. for 6 minutes, a 0.5 micron thick layer with 35 percent by weight of squaraine and 65 percent by weight of polyester was obtained. A solution for the hole transport layer was then prepared by dissolving 0.7 gras of N,N'-diphenyl-N,N'bis(3-methylphenyl)-[1,1'-biphenyl]-4,4'-diamine (TPD), 1.1 grams of Makrolon ® polycarbonate and 0.2 gram of the elastomeric block copolymer Kraton D-1116 in 10 milliliters of methylene chloride. This solution was then coated over the photogenerator layer by means of a Bird film applicator. The resulting member was then dried in a forced air oven at 135° C. for 20 minutes resulting in a 20 micron thick charge transport layer.

The fabricated imaging member was tested electrically in accordance with the procedure of Example V. Specifically, this imaging member was negatively charged to 800 volts and discharged when exposed to monochromatic light of a wavelength of 830 nanometers. The half decay exposure sensitivity for this device was 20 ergs/cm$^2$ and the residual potential was 15 volts. The electrical properties of this imaging member remained essentially unchanged after 1,000 cycles of repeated charging and discharging.

EXAMPLE IX

A layered photoresponsive imaging member comprised of TPD molecularly dispersed in a mixture of polycarbonate and the elastomeric block copolymer Kraton D-1116 as the hole transport layer, and an amorphous selenium generator layer was fabricated as follows:

A 0.5 micron thick layer of amorphous selenium on an aluminum plate of a thickness of 7 mils was prepared by vacuum deposition techniques. Vacuum deposition was accomplished in a Varian 3117 vacuum system at a pressure of $10^{-6}$ Torr, while the substrate was maintained at 50° C. A solution for the hole transport layer was then prepared by dissolving 0.8 gram of N,N'-diphenyl-N,N'bis(3-methylphenyl)-[1,1'-biphenyl]-4,4'-diamine (TPD), 1.0 gram of Makrolon ® polycarbonate, and 0.2 gram of the elastomeric block copolymer Kraton D-1116 in 10 milliliters of methylene chloride. This solution was then coated over the photogenerator layer by means of a Bird film applicator. The resulting member was then dried in a forced air oven at 135° C. for 20 minutes resulting in a 20 micron thick hole transport layer.

The fabricated imaging member was tested electrically in accordance with the procedure of Example V. Specifically, this imaging member was negatively charged to 800 volts and discharged when exposed to monochromatic light of a wavelength of 430 nanometers. The half decay exposure sensitivity for this device was 2.0 ergs/cm$^2$ and the residual potential was 20 volts. The electrical properties of this imaging member remained essentially unchanged after 1,000 cycles of repeated charging and discharging.

EXAMPLE X

A layered photoreponsive imaging member comprised of TPD molecularly dispersed in a mixture of polycarbonate and the elastomeric block copolymer Kraton D-1116 as the hole transport layer, and a vanadyl phthalocyanine generator layer was fabricated as follows:

A 0.8 micron thick photogenerator layer of vanadyl phthalocyanine was coated on a polysilane coated titanized Mylar in accordance with the procedure of Example V. A hole transport layer solution identical to that of Example IX was coated on top of the photogenerator layer and in the same manner. The resulting photoconductive device was then dried in a forced air oven at 135° C. for 20 minutes resulting in a 20 micron thick charge transport layer.

The fabricated imaging member was tested electrically in accordance with the procedure of Example V. Specifically, this imaging member was negatively charged to 800 volts and discharged when exposed to monochromatic light of a wavelength of 830 nanometers. The half decay exposure sensitivity for this device was 15 ergs/cm$^2$ and the residual potential was 50 volts. The electrical properties of this imaging member remained essentially unchanged after 1,000 cycles of repeated charging and discharging.

Other modifications of the present invention may occur to those skilled in the art and subsequent to a review of the present application, and these modifications are intended to be included within the scope of the present invention.

What is claimed is:

1. A photoresponsive imaging member comprised of a photogenerating layer, and a charge transport layer comprised of charge transport molecules and a resin binder mixture comprised of a polycarbonate and an elastomeric block copolymer comprised of an amorphous poly(b-styrene-b-butadiene-b-styrene).

2. A photoresponsive imaging member comprised of a photogenerating layer, and a hole transport layer comprised of hole transport molecules and a resin binder mixture comprised of a polycarbonate and the elastomeric amorphous block copolymer poly(b-styrene-b-butadiene-b-styrene), and wherein said elastomeric block copolymer is present in the mixture in an amount from about 1 to about 20 weight percent.

3. A photoresponsive imaging member comprised of a photogenerating layer, and a hole transport layer comprised of aryl amine hole transport molecules and a resin binder mixture comprised of a polycarbonate and the elastomeric amorphous block copolymer poly(b-styrene-b-butadiene-b-styrene) and wherein said elastomeric block copolymer is present in the mixture in an amount of from about 1 to about 20 weight percent.

4. A photoresponsive imaging member comprised of a supporting substrate, a photogenerating layer, and a hole transport layer comprised of charge transport molecules and a resin binder mixture comprised of a polycarbonate with a molecular weight of from about 20,000 to about 300,000 and the elastomeric amorphous block copolymer poly(b-styrene-b-butadiene-b-styrene), and wherein the resin binder mixture is comprised of from about 25 to about 80 weight percent of the polycarbonate and from about 20 to about 75 of the elastomeric block copolymer.

5. An imaging member in accordance with claim 2 wherein the resin mixture is comprised of from about 1 to about 20 percent by weight of the elastomeric block copolymer.

6. An imaging member in accordance with claim 4 wherein the photogenerating layer is situated between the supporting substrate and the charge transport layer mixture.

7. An imaging member in accordance with claim 4 wherein the supporting substrate is comprised of a conductive metallic substance, or an insulating polymeric composition overcoated with an electrically conductive layer.

8. An imaging member in accordance with claim 4 wherein the supporting substrate is aluminum, an organic polymeric composition, aluminized Mylar or titanized Mylar.

9. An imaging member in accordance with claim 4 wherein the photogenerating layer is comprised of photogenerating pigments dispersed in a resinous binder in an amount of from about 5 percent by weight to about 95 percent by weight.

10. An imaging member in accordance with claim 3 wherein the photogenerating layer is comprised of photogenerating pigments selected from the group consisting of metal free phthalocyanines, metal phthalocyanines, vanadyl phthalocyanine, titanyl phthalocyanine, selenium and selenium alloys.

11. An imaging member in accordance with claim 4 wherein the photogenerating pigment is selected from X-metal free phthalocyanine, vanadyl phthalocyanine, chloroindium phthalocyanine, titanyl phthalocyanine, bis(benzimidazo)perylene, benzylfluorinated squaraine and trigonal selenium.

12. An imaging member in accordance with claim 9 wherein the resinous binder is a polyester, poly(vinylbutyral), polycarbonate, poly(vinylformal), poly(vinylcarbazole), poly(vinylchloride), or mixtures thereof.

13. An imaging member in accordance with claim 1 wherein the charge transport layer is a hole transport layer comprised of aryl amine molecules of the formula

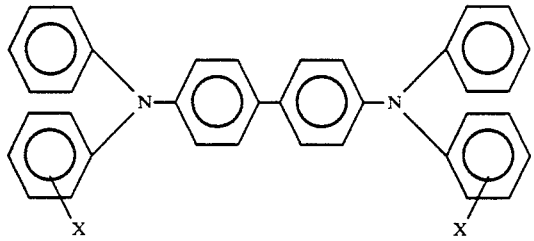

wherein X is selected from the group consisting of alkyl and halogen.

14. An imaging member in accordance with claim 13 wherein X is selected from the group consisting of ortho ($CH_3$), meta ($CH_3$), para ($CH_3$), ortho (Cl), meta (Cl), or para (Cl).

15. An imaging member in accordance with claim 2 wherein the charge transport layer is comprised of aryl amine molecules of the formula

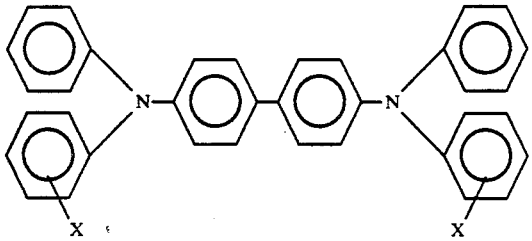

wherein X is selected from the group consisting of alkyl and halogen.

16. An imaging member in accordance with claim 1 wherein the charge transport layer is comprised of hole transporting polysilylenes of the formula

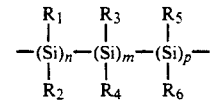

wherein $R_1$, $R_2$, $R_3$, $R_4$, $R_5$ and $R_6$ are independently selected from the group consisting of alkyl, aryl, substituted alkyl, substituted aryl, and alkoxy; and m, n, and p are numbers that represent the percentage of the monomer unit in the total polymer.

17. An imaging member in accordance with claim 16 wherein the polysilylenes are poly(methylphenyl) silylene, poly(cyclohexyl methyl) silylene, poly(beta-phenethylmethyl silylene), poly(n-propylmethyl silylene)-co-methylphenyl silylene, or poly(n-propylmethyl silylene).

18. An imaging member comprised of (1) a supporting substrate; (2) a siloxane hole blocking layer; (3) a photogenerating layer; and (4) a hole transport layer comprised of hole transport molecules and a resin binder mixture comprised of a polycarbonate and the elastomeric amorphous block copolymer poly(b-styrene-b-butadiene-b-styrene).

19. An imaging member in accordance with claim 18 wherein there is included between the siloxane hole blocking layer and the photogenerating layer an adhesive layer.

20. An imaging member in accordance with claim 18 wherein the adhesive layer is a polyester resin.

21. An imaging member in accordance with claim 18 wherein the hole transport layer comprises aryl amine molecules of the formula

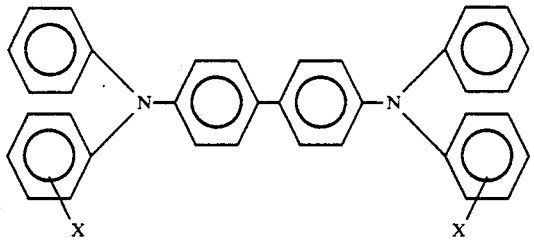

wherein X is selected from the group consisting of alkyl and halogen.

22. A method of imaging or printing which comprises generating an image on the imaging member of claim 1; developing the image generated; transferring the developed image to a suitable substrate; and thereafter affixing the image thereto.

23. A method of imaging or printing which comprises generating an image on the imaging member of claim 2; developing the image generated; transferring the developed image to a suitable substrate; and thereafter affixing the image thereto.

24. A method of imaging or printing which comprises generating an image on the imaging member of claim 3; developing the image generated; transferring the developed image to a suitable substrate; and thereafter affixing the image thereto.

25. A hole transport layer comprised of hole transport molecules dispersed in a resin binder mixture comprised of a polycarbonate and the elastomeric amorphous block copolymer poly(b-styrene-b-butadiene-b-styrene), and wherein the elastomeric block copolymer is present in the mixture in an amount from about 1 to about 20 weight percent.

26. A hole transport layer in accordance with claim 25 wherein the hole transport molecules are comprised of hole transporting aryl amines of the formula

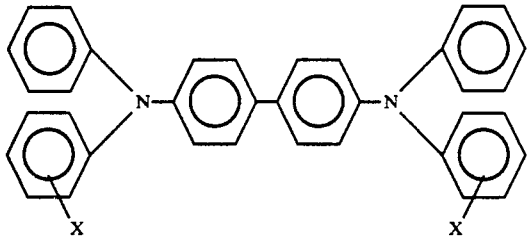

wherein X is selected from the group consisting of alkyl and halogen.

27. A photoconductive imaging member comprised of a photogenerating layer, and a hole transport layer comprised of hole transport molecules and a resin binder mixture comprised of a polycarbonate and the elastomeric amorophous block copolymer poly(b-styrene-b-butadiene-b-styrene).

28. An imaging member in accordance with claim 27 wherein the resin mixture is comprised of from about 1 to about 20 percent by weight of the elastomeric block copolymer, and from about 99 to about 80 weight percent of the polycarbonate.

29. An imaging member in accordance with claim 1 wherein crystallization of the charge transport layer is minimized.

30. An imaging member in accordance with claim 2 wherein crystallization of the hole transport layer is minimized.

31. An imaging member in accordance with claim 3 wherein crystallization of the hole transport layer is minimized.

32. An imaging member in accordance with claim 4 wherein crystallization of the charge transport layer is minimized.

33. An imaging member in accordance with claim 2 wherein crystallization of the hole transport layer is less than about 1 percent by weight.

34. An imaging member in accordance with claim 3 wherein crystallization of the hole transport layer is less than about 1 percent by weight.

35. An imaging member in accordance with claim 4 wherein crystallization of the hole transport layer is less than about 1 percent by weight.

36. An imaging member in accordance with claim 2 wherein crystallization of the hole transport layer is from about 0.50 to about 0.75 percent by weight.

37. An imaging member in accordance with claim 3 wherein crystallization of the hole transport layer is from about 0.50 to about 0.75 percent by weight.

38. An imaging member in accordance with claim 4 wherein crystallization of the hole transport layer is from about 0.50 to about 0.75 percent by weight.

39. A photoresponsive imaging member comprised of a supporting substrate, a photogenerating layer, and a hole transport layer comprised of hole transport molecules and a resin binder mixture comprised of a first resin polycarbonate with a molecular weight from about 20,000 to about 300,000 and as an elastomeric block copolymer amorphous poly(b-styrene-b-butadiene-b-styrene).

40. A photoresponsive imaging member comprised of a photogenerating layer, and a charge transport layer comprised of charge transport molecules and a resin binder mixture comprised of a first resin polycarbonate and a second elastomeric amorphous block copolymer of poly(b-styrene-b-butadiene-b-styrene) and wherein said mixture contains from about 1 to about 30 weight percent of the elastomeric block copolymer.

41. An imaging member in accordance with claim 1 wherein the polycarbonate is present in an amount of about 25 to about 80 percent by weight.

42. An imaging member in accordance with claim 1 wherein the polycarbonate is present in an amount of from about 35 to about 50 percent by weight.

43. An imaging member in accordance with claim 1 wherein the elastomeric amorphous block copolymer is present in an amount of from about 2 to about 20 percent by weight.

44. An imaging member in accordance with claim 1 wherein the elastomeric copolymer is present in an amount of 5 weight percent.

* * * * *